US010174893B2

(12) United States Patent
Kim

(10) Patent No.: US 10,174,893 B2
(45) Date of Patent: Jan. 8, 2019

(54) LED STREETLAMP

(71) Applicant: KMW Inc., Hwaseong, Gyeonggi-Do (KR)

(72) Inventor: Duk-Yong Kim, Gyeonggi-do (KR)

(73) Assignee: Gigatera Inc., Hwaseong-si (KR)

( * ) Notice: Subject to any disclaimer, the term of this patent is extended or adjusted under 35 U.S.C. 154(b) by 0 days.

(21) Appl. No.: 15/054,698

(22) Filed: Feb. 26, 2016

(65) Prior Publication Data

US 2016/0178148 A1 Jun. 23, 2016

Related U.S. Application Data

(63) Continuation of application No. PCT/KR2014/007932, filed on Aug. 26, 2014.

(30) Foreign Application Priority Data

Aug. 26, 2013 (KR) ..... 10-2013-0101092

(51) Int. Cl.
*F21V 29/70* (2015.01)
*F21S 8/08* (2006.01)
(Continued)

(52) U.S. Cl.
CPC ..... *F21S 8/085* (2013.01); *F21K 9/60* (2016.08); *F21S 8/086* (2013.01); *F21V 15/01* (2013.01);
(Continued)

(58) Field of Classification Search
CPC .. F21K 9/60; F21S 8/085; F21S 8/086; F21V 15/01; F21V 23/002; F21V 23/023;
(Continued)

(56) References Cited

U.S. PATENT DOCUMENTS 7,347,706 B1 * 3/2008 Wu ..... H01R 13/7175 430/642
7,674,012 B1 * 3/2010 Lin ..... F21V 29/004 362/240
(Continued)

FOREIGN PATENT DOCUMENTS

CN 102207282 A 10/2011
CN 202452204 U 9/2012
(Continued)

OTHER PUBLICATIONS

EP Search Report dated Dec. 16, 2016 issued in corresponding European Patent Application No. EP 14840378.5.

*Primary Examiner* — Claude J Brown
(74) *Attorney, Agent, or Firm* — Mintz Levin Cohn Ferris Glovsky and Popeo, P.C.; Kongsik Kim; Jhongwoo Jay Peck

(57) ABSTRACT

A LED streetlamp is provided. The LED streetlamp includes an integral housing having a light-emitting opening that emits light from a bottom surface and an accommodation space; a power supply unit coupled to the accommodation space through the light-emitting opening of the housing; a reflecting part coupled to the accommodation space through the light-emitting opening of the housing to separate power supply unit from the accommodation space of the lower part and reflecting light from a bottom surface thereof; a substrate for supplying power to multiple LEDs coupled to an inner side surface of the housing of a lower side of the reflecting part; and a cover part. A case with a single structure is provided and includes the power supply unit, the substrate having the LEDs and the reflecting plate to be assembled in the case through the light emitting opening to reduce a manufacturing cost.

6 Claims, 10 Drawing Sheets

(51) Int. Cl.

| | |
|---|---|
| ***F21V 23/02*** | (2006.01) |
| ***F21K 9/60*** | (2016.01) |
| ***F21V 15/01*** | (2006.01) |
| ***F21V 23/00*** | (2015.01) |
| *F21W 111/02* | (2006.01) |
| *F21V 29/508* | (2015.01) |
| *F21W 131/103* | (2006.01) |
| *F21Y 115/10* | (2016.01) |
| *F21V 27/02* | (2006.01) |

(52) U.S. Cl.
CPC ..... *F21V 23/009* (2013.01); *F21V 23/023* (2013.01); *F21V 23/026* (2013.01); *F21V 23/002* (2013.01); *F21V 27/02* (2013.01); *F21V 29/508* (2015.01); *F21W 2111/02* (2013.01); *F21W 2131/103* (2013.01); *F21Y 2115/10* (2016.08)

(58) Field of Classification Search
CPC ..... F21V 23/026; F21V 23/009; F21V 27/02; F21V 29/508
USPC ..... 362/235
See application file for complete search history.

(56) References Cited

U.S. PATENT DOCUMENTS

| | | | | |
|---|---|---|---|---|
| 8,322,881 | B1 * | 12/2012 | Wassel | F21V 7/00 362/217.05 |
| 2006/0183359 | A1 * | 8/2006 | Gerber | H01R 13/6464 439/76.1 |
| 2008/0068799 | A1 * | 3/2008 | Chan | F21V 29/004 361/697 |
| 2009/0225554 | A1 * | 9/2009 | Chang | F21V 29/004 362/373 |
| 2009/0244895 | A1 * | 10/2009 | Chen | F21V 29/75 362/249.02 |
| 2009/0310381 | A1 * | 12/2009 | Chang | F21V 29/004 362/555 |
| 2010/0134046 | A1 * | 6/2010 | Holder | F21V 29/70 315/297 |
| 2010/0135011 | A1 * | 6/2010 | Richardson | F21S 8/086 362/234 |
| 2011/0068708 | A1 * | 3/2011 | Coplin | F21K 9/00 315/294 |
| 2011/0235343 | A1 | 9/2011 | Arai | |
| 2012/0002413 | A1 * | 1/2012 | Kim | F21S 2/005 362/235 |
| 2012/0113655 | A1 * | 5/2012 | Huang | F21V 19/001 362/373 |
| 2012/0127727 | A1 * | 5/2012 | Wan-Chih | F21S 8/08 362/294 |
| 2012/0206927 | A1 * | 8/2012 | Miyahara | F21V 29/004 362/382 |
| 2012/0294018 | A1 * | 11/2012 | Kim | F21S 8/086 362/382 |
| 2013/0077311 | A1 * | 3/2013 | Kinnune | F21V 29/004 362/249.02 |
| 2013/0083516 | A1 * | 4/2013 | Yoon | F21V 29/004 362/190 |
| 2013/0148360 | A1 * | 6/2013 | Jeon | F21V 31/03 362/294 |
| 2013/0155673 | A1 | 6/2013 | Wang et al. | |
| 2013/0201691 | A1 | 8/2013 | Chuang | |
| 2013/0343045 | A1 * | 12/2013 | Lodhie | F21S 8/086 362/184 |
| 2014/0049961 | A1 * | 2/2014 | Wilcox | F21V 5/04 362/244 |
| 2014/0111987 | A1 | 4/2014 | Kim | |
| 2014/0211470 | A1 * | 7/2014 | Kinnune | F21S 8/086 362/249.02 |
| 2014/0334148 | A1 | 11/2014 | Lee et al. | |
| 2015/0023015 | A1 | 1/2015 | Ishida et al. | |

FOREIGN PATENT DOCUMENTS

| | | | |
|---|---|---|---|
| EP | 2372227 | A2 | 10/2011 |
| EP | 2623852 | A2 | 8/2013 |
| KR | 20-2008-0005178 | U | 11/2008 |
| KR | 20-2009-0011424 | U | 11/2009 |
| KR | 10-1016923 | B1 | 2/2011 |
| KR | 10-1024938 | B1 | 3/2011 |
| KR | 10-2013-0028408 | A | 3/2013 |
| KR | 10-2013-0063288 | | 6/2013 |
| WO | WO-2002-101285 | A1 | 12/2002 |
| WO | WO-2012-128299 | A | 9/2012 |
| WO | WO-2012-161426 | A2 | 11/2012 |
| WO | WO-2013-085244 | A1 | 6/2013 |

* cited by examiner

LED STREETLAMP

CROSS REFERENCE TO RELATED APPLICATIONS

This application is a continuation of International Application No. PCT/KR2014/007932 filed on Aug. 26, 2014, which claims priority to Korean Application No. 10-2013-0101092 filed on Aug. 26, 2013, which applications are incorporated herein by reference.

TECHNICAL FIELD

The present disclosure relates to a Light Emitting Diode (LED) streetlamp and, more particularly, to an LED streetlamp which can be easily installed and separated, and can reduce manufacturing costs thereof by minimizing the number of components.

BACKGROUND ART

In recent years, with an increase in an amount of power consumption, a probability that a blackout occurs has increased even in Korea, and thus, various policies, which can reduce power consumption when an amount of power consumption is large, have been proposed. For example, various methods may be enacted, such as imposing of a fine when the total amount of energy consumption of a building exceeds a reference value, changing of a lunch time of Seoul, changing of a dress-code, and adjusting of a running interval of a subway.

In this way, a streetlamp using an LED which has a remarkably lower power consumption than the existing streetlamp is proposed as one alternative for reducing an amount of power consumption. However, since an LED streetlamp is relatively expensive as compared with the existing streetlamp, it is difficult to commercialize the LED streetlamp.

An example of the conventional LED streetlamp corresponds to Korean Patent Registration NO. 10-1024938 (LED streetlamp having excellent luminance and heat dissipation).

A schematic structure of this conventional technology includes a case obtained by assembling an upper part and a lower part thereof, which are manufactured individually, a power supply unit provided inside the case, an LED lamp, and a heat dissipation plate, wherein a fixing part for connecting the LED streetlamp to a column is provided at the back end of the upper part of the case.

In this way, in the case of the conventional LED streetlamp, the upper part and the lower part of the case constituting the outer appearance are manufactured individually, components such as the LED lamp and the power supply unit are fixedly installed inside the case, and the upper part and the lower part of the case are then coupled to each other.

The reason why a unit cost of the LED streetlamp is higher than the existing streetlamp is individual manufacturing of the upper part and the lower part of the case, individual production of a cover for mounting components to the case and maintenance thereof, fixed installation of individual components to the upper part and the lower part of the case, and a large amount of working time for assembling the upper part and the lower part of the case to each other as well as basic and structural reasons such as a difference between costs of light sources and addition of the power supply unit for converting Alternating Current (AC) power into Direct Current (DC) power and supplying the converted DC power to the LED.

Further, there are problems in that an operation of coupling the LED streetlamp to the column is performed at an elevated place, it is difficult for a worker to maintain a weight of electric wire itself connected from the ground via the interior of the column to an upper end of the column where the LED streetlamp is installed, and the operation is not easy due to weight of the LED streetlamp.

SUMMARY

In order to solve the above problems, an aspect of the present disclosure is to provide an LED streetlamp which can reduce the number of components manufactured individually and reduce time consumed for assembling.

Another aspect of the present disclosure is to provide an LED streetlamp which can be easily coupled to the column.

In order to solve the above problems, an LED streetlamp according to the present disclosure may include: an integral housing having a light emitting opening on the bottom thereof, through which light is emitted, and a receiving space provided therein; a power supply unit inserted and fixed in the receiving space through the light emitting opening of the housing; a reflection part for separating a part of the receiving space where the power supply unit is located and a portion of the receiving space lower than the part and reflecting light from the bottom thereof, the reflection part being inserted and fixed to the receiving space through the light emitting opening of the housing; a substrate for supplying power to a plurality of mounted LEDs, the substrate being fixedly coupled to the inner surface of the housing on the lower side of the reflection part; and a cover part for coving the light emitting opening of the housing.

DETAILED DESCRIPTION

Hereinafter, an LED lighting device according to the present disclosure will be described in detail with reference to the accompanying drawings.

Figure 1:
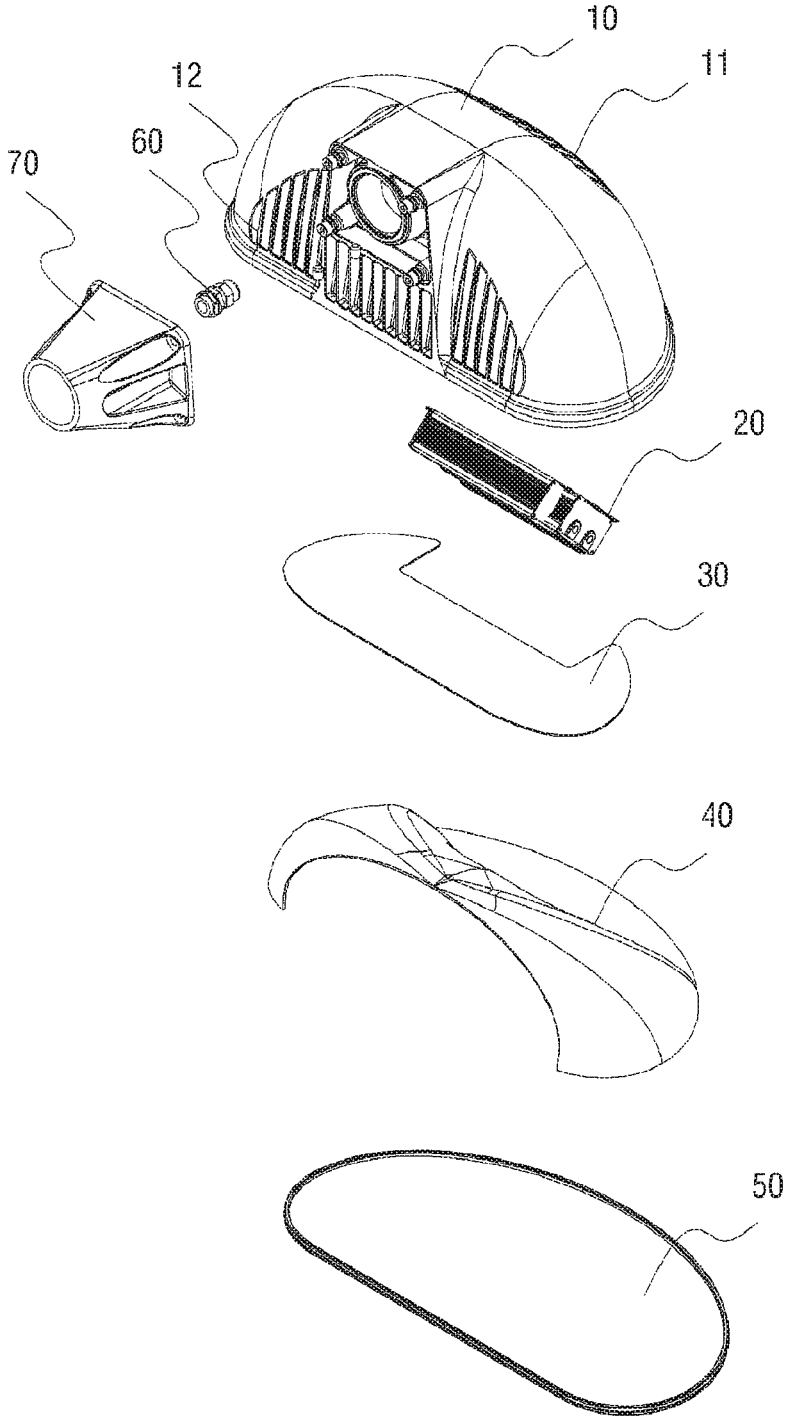
FIG. 1 is an exploded perspective view according to a preferred embodiment of the present disclosure.
Figure 2:
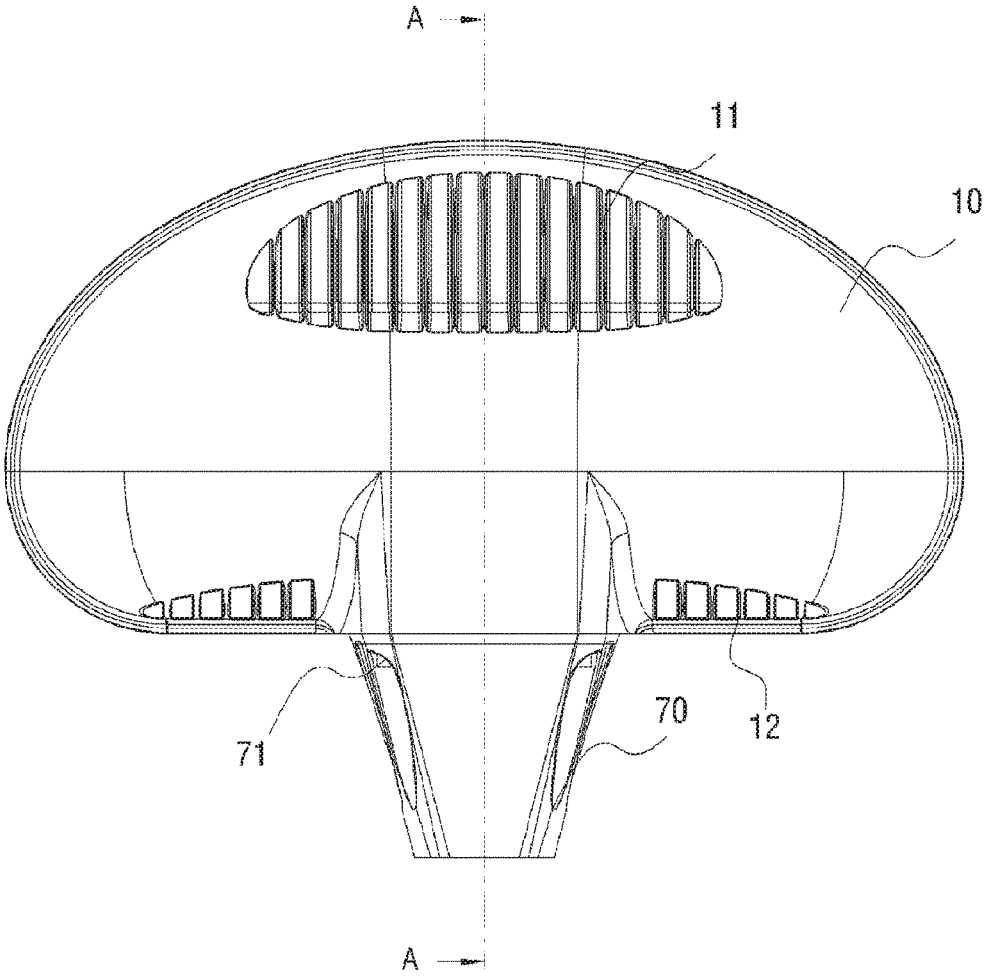
FIG. 2 is a plan view illustrating a coupling state of an LED streetlamp according to a preferred embodiment of the present disclosure.
Figure 3:
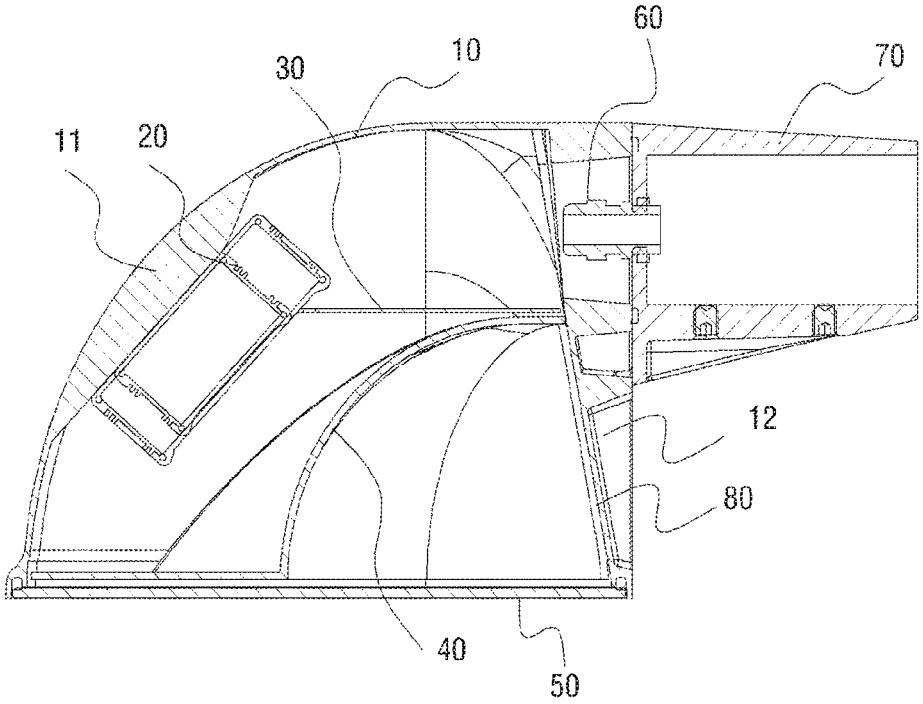
FIG. 3 is a sectional view taken along line A-A of FIG. 2.

FIG. 1 is an exploded perspective view illustrating an LED streetlamp according to a preferred embodiment of the present disclosure, FIG. 3 is a plan view illustrating a coupling state of the LED streetlamp, and FIG. 3 is a sectional view taken along line A-A of FIG. 2.

Referring to FIGS. 1 to 3, an LED streetlamp according to a preferred embodiment may include: a housing having a light emitting opening on the bottom thereof and a receiving space therein; a power supply unit 20 for converting AC power from the outside into DC power and supplying the converted DC power; a fixing plate 30 for fixing the power supply unit 20; a reflection part 40 for reflecting light, the reflection part 40 being inserted into an internal space of the housing 10 on the lower side of the fixing plate 30; a substrate 80 for supplying DC current supplied from the power supply unit 20 to a plurality of LEDs mounted thereon, the substrate being attached on the inner side surface at the rear end of the housing 10; a cover part 50 coupled to block the light emitting opening on the bottom of the housing 10; a flange part 70 coupled to the rear end of the housing 10 in a state in a state in which a column is inserted; and a fixing part 60 for fixing a wire inside the column, the fixing part 60 being coupled to the flange part 70.

Figure 4:
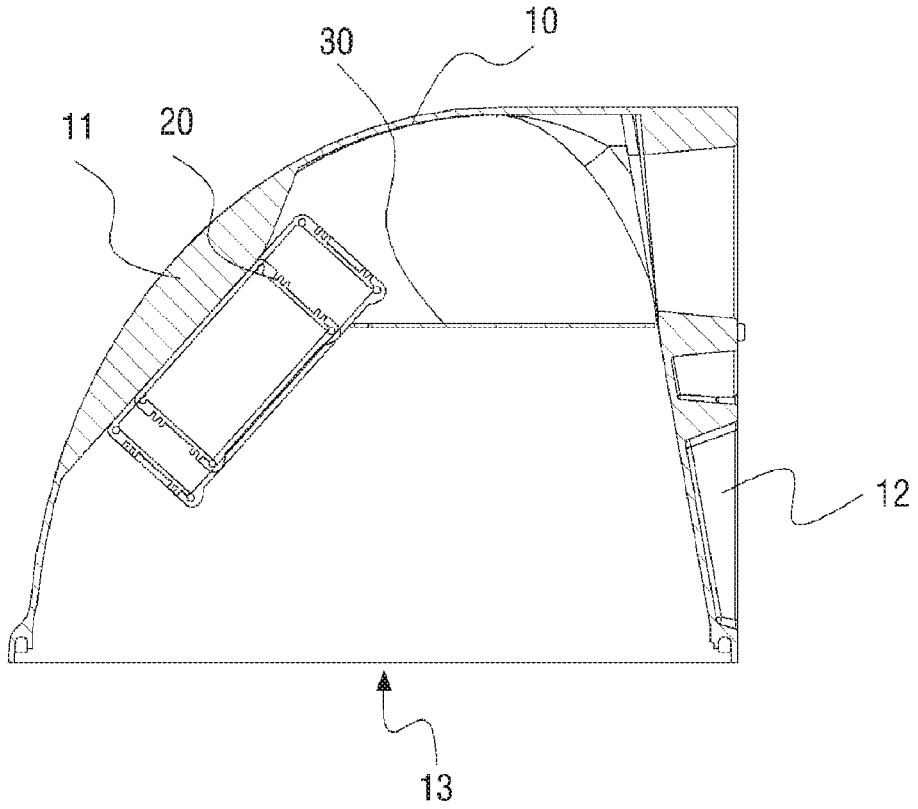
FIGS. 4 to 6 are sectional views illustrating a coupling sequence of the LED streetlamp according to the preferred embodiment of the present disclosure.
Figure 5:
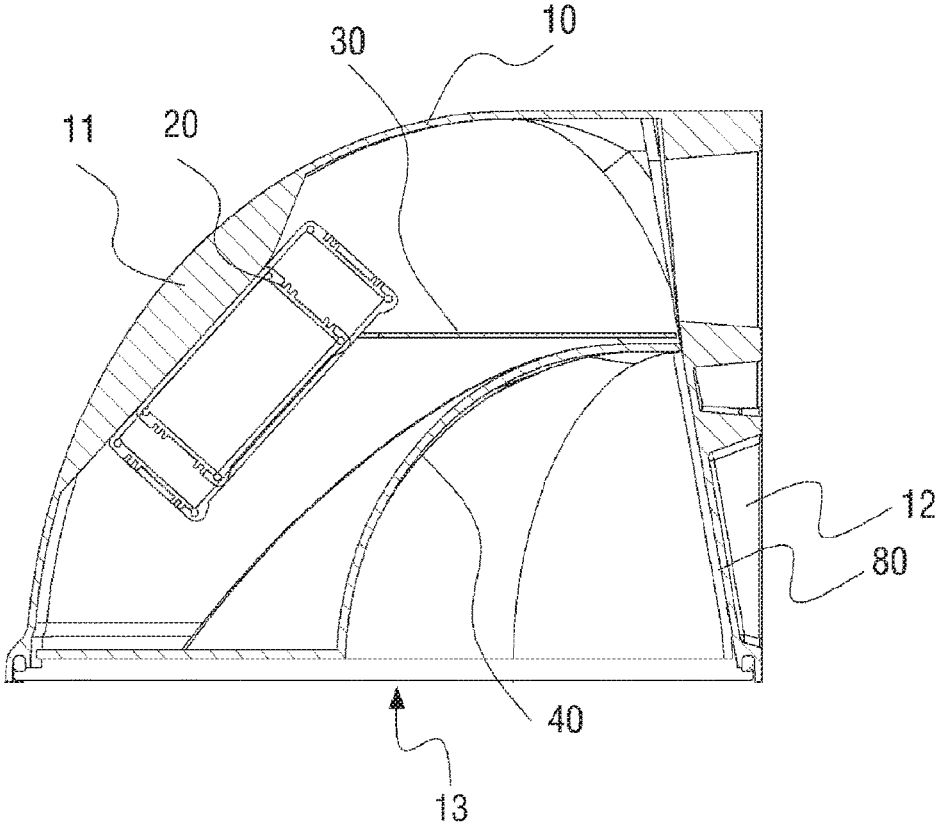
Figure 6:
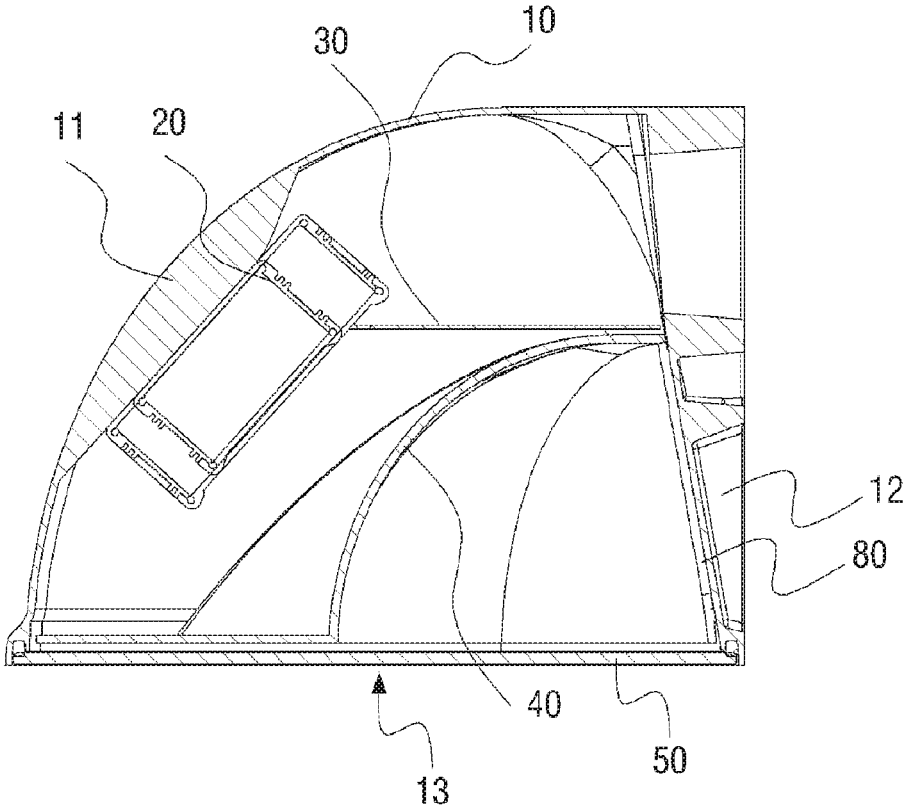

FIGS. 4 to 6 are sectional views illustrating a coupling sequence to the LED streetlamp according to the preferred embodiment of the present disclosure, and a configuration and an operation of the LED streetlamp according to the preferred embodiment of the present disclosure will be described below in detail with reference to FIGS. 4 to 6 together with FIGS. 1 to 3.

The housing 10 has an integral structure including a light emitting opening 13 on the bottom thereof and a receiving space therein. As illustrated in FIG. 2 through which the plan shape of the housing 10 can be identified, the housing may have an elliptical shape in which the horizontal width is larger than the vertical width. This is because the streetlamp should provide light distribution having a shape wider with respect to the lengthwise direction of a road, and the shape of the housing 10 can be variously changed and implemented.

However, the housing 10 has a structure including a receiving space therein, a light emitting opening 13 having the bottom opened entirely, a first heat dissipation pin 11 formed on the outer surface on the upper side of the front end in an installation state, and a second heat dissipation pin 12 formed at the rear end.

The light emitting opening 13 allows light of an LED, which will be described below, to be emitted therefrom and illuminate a road and acts as a path for an assembling operation which allows the power supply unit 20, the fixing plate 30, the reflection plate 40 and the substrate 80 on which the LED is mounted, to be fixedly installed in the receiving space in the housing 10.

As illustrated in FIG. 4, the power supply unit 20 is inserted and fixed, through the light emitting opening 13, in the receiving space inside the housing 10 in contact with the first heat dissipation pin 11. At this time, an electric wire for supplying AC current to the power supply unit 20 can extend toward the rear end to be exposed to the outside, and is then connected to an electric wire fixed by the fixing part 60.

Further, the fixing plate 30 is inserted through the light emitting opening 13, thereby more firmly fixing the power supply unit 20, and a lower area and an upper area of the housing 10 are partitioned from each other with reference to the fixing plate 30. In this way, the reason why the areas are partitioned is to prevent moisture from being introduced and prevent dust, and the like from being introduced.

The power supply unit 20 generates heat during an operation process, and the heat is discharged through a first radiation pin 11 integrally formed in the housing 10.

Next, as illustrated in FIG. 5, the reflection part 40 is inserted and fixed through the light emitting opening 13 of the housing, into which the fixing plate 30 is inserted, and the substrate 80 is fixed on the inner surface of the housing, which is in contact with the second heat dissipation pin 12.

A structure, which reflects light of a plurality of LEDs (not illustrated in drawing) mounted on the substrate 80 to emit the reflected light through the light emitting opening 13 and completely horizontally blocks the receiving space of the housing 10 such that the light of the LEDs is not introduced to the power supply unit 20 or the fixing plate 30 in order to improve light efficiency, can be used as the reflection part 40.

As can be identified in FIGS. 1 and 3, although the reflection part 40 is illustrated as having a plurality of semi-spherical patterns having different curvatures, which are formed therein for light distribution, the reflection part 40 is merely one example, and can be implemented in various shapes for efficient light distribution.

Although not illustrated in the drawings, an electric wire, through which the DC power of the power supply unit 20 is supplied, is connected to the substrate 80, and the LEDs are supplied with the power so as to emit light. As known, heat is generated by the LEDs, and the heat of the LEDs is discharged through the second dissipation pin 12.

Next, as illustrated in FIG. 6, the cover part 50 is coupled to the light emitting opening 13. The cover part 50 may be a lens capable of forming desired light distribution, a diffusing plate, or a transparent plate for preventing foreign substances from being introduced thereinto.

In this way, in the present disclosure, the power supply unit 20, the reflection part 40 and the substrate 80, which should be necessarily used to illuminate a road, can be inserted and fixedly installed through the light emitting opening 13 of the housing, so that the housing 10 can be integrally formed and manufactured, and manufacturing costs thereof can be remarkably reduced as compared with the conventional scheme in which an upper housing and a lower housing are manufactured, respectively, and are then assembled to each other.

Further, time consumed for an assembling process is reduced, thereby improving productivity, and thus, reducing manufacturing costs.

Figure 7:
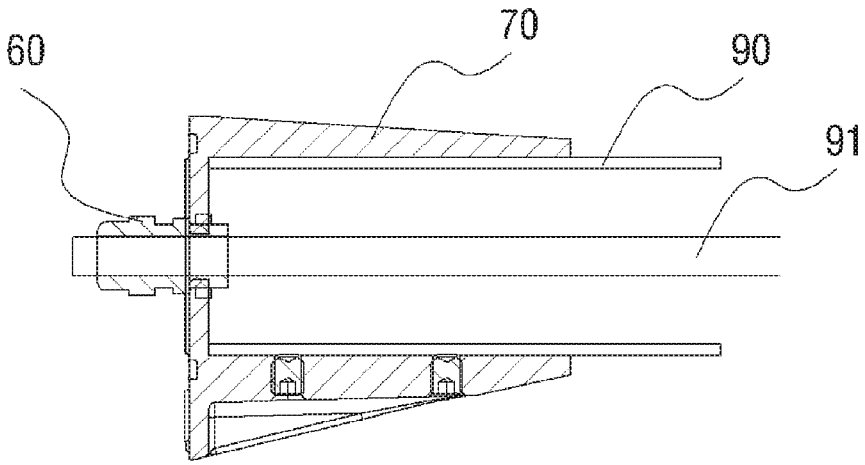
FIGS. 7 and 8 are sectional views illustrating a sequence of installing the present disclosure to a column.
Figure 8:
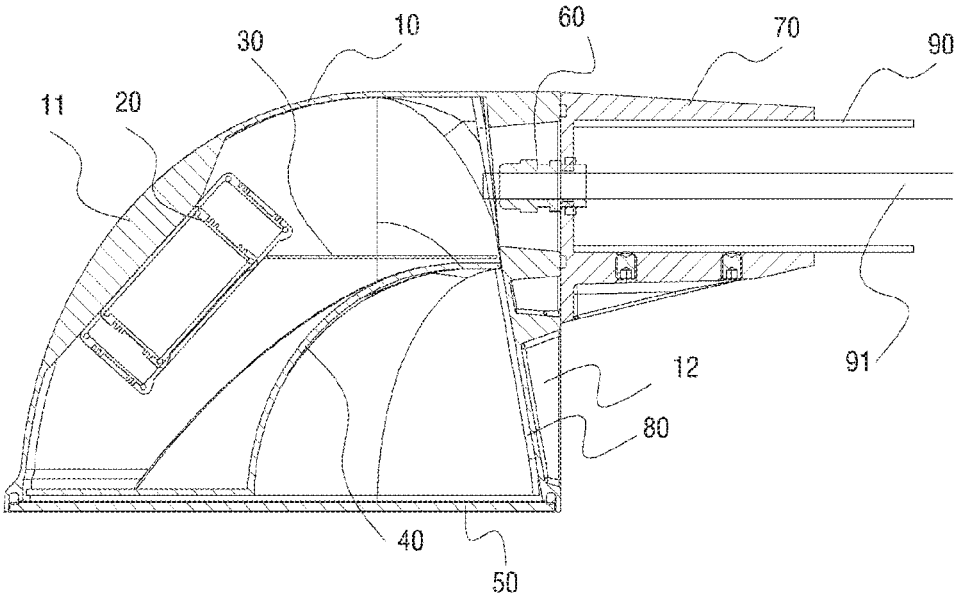

FIGS. 7 and 8 are sectional views illustrating a sequence of installing the above-assembled structure to a column.

Referring to FIG. 7, a worker inserts and fixes one end of the column 90 to the flange part 70 while inserting and fixing an electric wire 91 laid in the column 90 to the fixing part 60 coupled to the flange part 70.

A structure, which prevents the electric wire 91 from not deviating, by pressing an elastic body to the center by clamping between a nut and the elastic body surrounding the electric wire 91, can be adopted as the fixing part 60. Further, when a structure can fix the electric wire 91, the structure can be applied to the present disclosure without limitation.

The electric wire 91 is buried on or under the ground, extends to an elevated place along the interior of the column 90, and thus, has a large weight. However, as described above, when the electric wire 91 is fixed through the fixing part 60, the worker can comfortably perform a task without feeling the weight of the electric wire 91.

Next, as illustrated in FIG. 8, a rear end of the housing assembled in a process illustrated in FIGS. 4 to 6 faces the flange part 70, an electric wire for supplying AC current to the power supply unit 20 is connected to the electric wire 91 fixed by the fixing part 60, and the housing 10 is coupled and fixed to the flange part 70 through a bolt 71.

Through this process, the worker can install the LED streetlamp more easily. In particular, when the diameter of the column 90 is different, the LED streetlamp can be installed by replacing only the flange part 70 with another one without changing the structure of the housing 10. Thus, the housing 10 can be manufactured in a singular design, thereby preventing an increase in manufacturing costs resulting from a design change.

Figure 9:
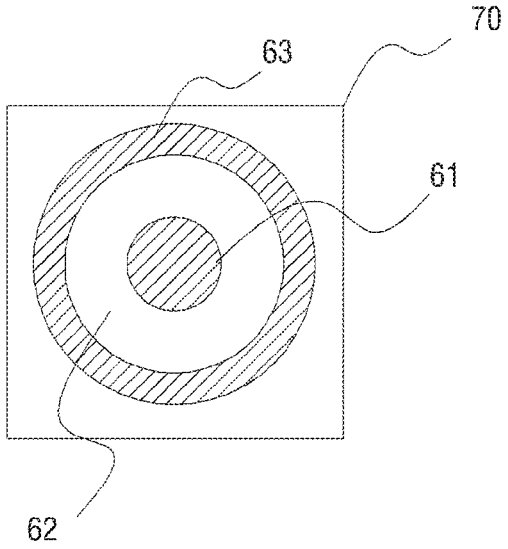
FIGS. 9 and 10 illustrate other configurations of a fixing part applied to the present disclosure, respectively.

FIG. 9 is a front view illustrating the flange part 70 and the fixing part 60 according to another embodiment.

Referring to FIG. 9, the fixing part 60 may include a first central electrode 61, an insulation body 62 surrounding the first electrode 61, and a second electrode 63 provided on the periphery of the insulation body 62, such that a contact point between the fixing part 60 and the housing 10 can be made by being connected to the electric wire 91.

The above-configured contact point may be identically provided at the rear end of the housing 10, and can allow AC power supplied through the electric wire 91 to be supplied to the power supply unit 20 fixedly installed in the housing 10 only by coupling the housing 10 and the flange part 70 to each other.

Figure 10:
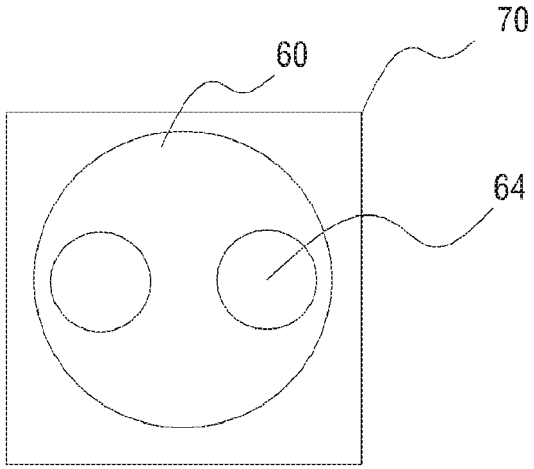

FIG. 10 is a front view illustrating the flange part 70 and the fixing part 60 according to another embodiment. Referring to FIG. 10, the fixing part 60 in contact with the housing 10 is formed in the shape of a socket 64, the electric wire 91 is connected thereto, and a plug protruding from the housing 10 is inserted into the fixing part 60 when the flange part 70 and the housing 10 are coupled to each other, so that the socket 64 and the plug allow the AC power supplied through the electric wire to be supplied to the power supply unit 20 fixedly installed in the housing 10 only by coupling the housing 10 and the flange part 70 to each other.

The LED streetlamp according to the present disclosure has a case manufactured in a singular structure, and is configured such that components such as a power supply unit, a substrate on which an LED is mounted, and a reflection plate can be assembled to each other within the case through a light emitting opening, thereby minimizing manufacturing costs, and thus, advancing the commercialization of the LED streetlamp.

Further, the LED streetlamp according to the present disclosure has an effect by which installation of the LED street lamp is made easier by installing a bracket for supporting weight of a wire provided inside a column from one end of the column and mutually coupling the bracket and the case such that a worker does not under the burden of the weight of the electric wire and weight of the LED streetlamp at the same time.

It would be obvious to those skilled in the art to which the present disclosure pertains that the present disclosure can be variously changed and modified without departing from the technical spirit of the present disclosure.

What is claimed is:

1. A Light Emitting Diode (LED) streetlamp comprising:

an integral housing having a light emitting opening on a bottom thereof and a receiving space provided therein;

a power supply unit inserted and fixed to the receiving space through the light emitting opening of the housing;

a reflection part for reflecting light from a bottom thereof, the reflecting part being inserted and fixed to the receiving space through the light emitting opening of the housing to separate a part of the receiving space where the power supply unit is located and a portion of the receiving space lower than the part;

a substrate for supplying power to a plurality of mounted LEDs, the substrate being coupled and fixed on an inner surface of the housing on a lower side of the reflection part; and a cover part for covering the light emitting opening of the housing;

wherein the housing comprises:

a first heat dissipation fin for dissipating heat of the power supply unit, the first heat dissipation fin being provided on an outer side of a coupling location of the power supply unit and on a upper side of the reflection part;

a second heat dissipation fin for dissipating heat of the substrate, the second heat dissipation fin being provided on an outer side of a coupling location of the substrate and on the lower side of the reflection part;

a fixing plate for fixing the power supply unit disposed within the receiving space of the housing that partitions a lower portion from an upper portion of the housing; and a flange mounting portion at a rear end of the housing for coupling and fixing a flange part with a bolt.

2. The LED streetlamp of claim 1, wherein the reflection part reflects light emitted from the LED, emits the reflected light through the light emitting opening.

3. The LED streetlamp of claim 1, wherein the flange part is coupled to a column such that one end of the column is inserted in the flange part.

4. The LED streetlamp of claim 1, wherein a fixing part for fixing a laid electric wire through an interior of the column is coupled to the flange part.

5. The LED streetlamp of claim 4, wherein the fixing part comprises an elastic body surrounding the electric wire and a nut for preventing the electric wire from deviating by tightening the elastic body.

6. The LED streetlamp of claim 4, wherein the fixing part provides an electric contact part in a coupled state with the flange part.

* * * * *